United States Patent [19]

Berghausen, III

[11] 4,152,305

[45] May 1, 1979

[54] NONTOXIC GENERAL PURPOSE LIQUID CLEANING COMPOSITIONS

[75] Inventor: Alfred Berghausen, III, Cincinnati, Ohio

[73] Assignee: Safe-Tech, Inc., Cincinnati, Ohio

[21] Appl. No.: 481,173

[22] Filed: Jun. 20, 1974

[51] Int. Cl.[2] ..... C11D 3/04; C11D 3/20; C11D 3/43; C11D 17/08

[52] U.S. Cl. ..... 252/523; 8/137; 252/89 R; 252/135; 252/139; 252/153; 252/156; 252/158; 252/173; 252/DIG. 5; 252/DIG. 14

[58] Field of Search ..... 252/DIG. 10, DIG. 14, 252/135, 139, 523, 541, 153, 156, 158, 173, 89, 132, 110, 111, 114, 118, DIG. 5

[56] References Cited

U.S. PATENT DOCUMENTS

| | | | |
|---|---|---|---|
| 41,553 | 2/1864 | Warren | 252/111 |
| 95,312 | 9/1869 | Breed | 252/111 |
| 342,279 | 5/1886 | Buchten | 252/99 |
| 651,536 | 6/1900 | Stern | 252/523 X |
| 731,521 | 6/1903 | Sudman | 252/111 |
| 2,947,702 | 8/1960 | Coskie | 252/525 |
| 2,982,739 | 5/1961 | Dvorkovitz | 252/156 |
| 3,453,144 | 7/1969 | Morgan | 252/116 X |
| 3,629,121 | 12/1971 | Eldib | 252/89 |
| 3,679,609 | 7/1972 | Castner | 252/527 |
| 3,694,365 | 9/1972 | Castner | 252/106 |
| 3,709,825 | 1/1973 | Chirash | 252/158 |
| 3,749,675 | 7/1973 | Chang | 252/135 |
| 3,835,070 | 9/1974 | Beck | 252/526 |

FOREIGN PATENT DOCUMENTS

| | | | |
|---|---|---|---|
| 1319 of | 1877 | United Kingdom | 252/111 |

OTHER PUBLICATIONS

P. J. Borchert et al.: "Citrate Based Laundry Detergents", *Soap/Cosmetics/Chemical Specialties,* Jun., 1973, pp. 31, 32, 36, 37, 68 & 70.

*Primary Examiner*—Dennis L. Albrecht
*Attorney, Agent, or Firm*—Wood, Herron & Evans

[57] ABSTRACT

This invention relates to liquid cleaning compositions and more particularly, to compositions that have a low pH, i.e., about 9.5 or below, and which consist essentially of, on a weight basis, about 3–10% surfactant, 1–3% isopropyl alcohol, 1–3% citric acid, 0.5 to 1.6% sodium tetraborate, 0.02 to 1.2% anhydrous sodium hydroxide, 0 to 1.0% anhydrous ammonium hydroxide and 84 to 95% water.

4 Claims, No Drawings

NONTOXIC GENERAL PURPOSE LIQUID CLEANING COMPOSITIONS

BACKGROUND OF THE INVENTION

This invention relates to general purpose liquid detergents especially adapted for household use. The compositions of this invention clean effectively at low pH levels, are non-toxic, noncorrosive, biodegradeable, and contain no phosphates.

Liquid cleaning compositions have been offered for sale for many years now. Some are especially formulated for household usage. Their uses include cleaning stoves, table tops, windows, woodwork, walls, and floors. Because of such diverse uses, such compositions must satisfy a great number of performance criteria. For example, such compositions must be able to clean surfaces that contain all types of dirt, grease, grime, food, etc., without damaging the surface sought to be cleaned and without leaving any undesirable residue. In order to clean such surfaces it has been generally considered necessary to formulate compositions which have a pH of between 10 and 12.5.

Other compositions for use in the home have been formulated for more specific uses, must satisfy other performance criteria, and are not considered to be general all purpose cleaners. One such example is a composition for cleaning rugs. For such use it has been determined that such compositions should have a pH of no more than about 9.5 since pH's above this level can seriously degrade the carpet dyes or the carpet itself.

Liquid cleaning compositions are also formulated for institutional and industrial usages. In most instances such compositions are formulated to suit particular uses. Most of the time their compositions differ substantially from household liquid cleaning detergents. Like most household compositions, they, too, have high ph's.

Even though a household or industrial composition meets its intended performance criteria, it still must meet other requirements, which while not directly related to the utility of the composition, must be satisfied in order for it to be legally marketable. For example, the Federal Hazardous Substances Act regulates the sale of materials including liquid detergent compositions. Most particularly, it prescribes the conditions for sale of such materials which are found to be toxic, corrosive or irritants, as such terms are defined in the applicable Rules and Regulations promulgated under the Act. Environmental statutes are also involved. In recent years environmental criteria have become especially important and it is now a requirement that a liquid cleaning composition contain low levels of phosphate builder salts. In fact, many cleaning compositions are now being formulated with no phosphate builder salts at all. In addition, and again for environmental reasons, liquid cleaning compositions must be readily biodegradeable.

The basic objective of my invention has been to provide a liquid cleaning composition that: (1) satisfies the performance criteria for general home usage including use as a rug cleaner; (2) is non-hazardous; (3) is biodegradeable; and (4) contains no phosphates.

While the prior art is replete with prior art patents attempting to satisfy the foregoing criteria, none has been entirely successful nor has provided all of the attendant benefits and advantages of the compositions disclosed herein. The prior art patents relating to such compositions that are known to me consist of U.S. Pat. Nos. 275,189, 342,279, 1,609,847, 1,657,147, 1,870,804, 2,313,425, 2,623,856, 3,306,860, 3,671,439, 3,674,699, 3,703,469, 3,708,364, 3,708,427, 3,709,825, and 3,749,675.

SUMMARY OF THE INVENTION

It has been discovered that liquid cleaning compositions which satisfy the criteria of performance, ecology, and human safety are formulated from a surfactant, as for example a nonionic surfactant, isopropyl alcohol, citric acid, sodium hydroxide, borax and water. In use such compositions have a relatively low pH level, i.e., about 9.5 or below, are readily biodegradeable, and clean very effectively without the need for phosphate builder salts. Because of their composition, a low pH, about 9.5 or below, the compositions may be sold without the need for hazardous substance warning labels. More specifically, such compositions are classified as nontoxic by ingestion, not a primary skin irritant, not corrosive to the skin, and not an eye irritant, within the meaning of the Federal Hazardous Substances Act.

DESCRIPTION OF THE PREFERRED EMBODIMENTS

In the preferred embodiment of the present invention the compositions are formulated from the following ingredients (percentages by weight): 3 to 10% of a nonionic surfactant; 1 to 3% of a water soluble, nontoxic alcohol, as for example, isopropyl alcohol; 1 to 3% of citric acid; 0.5 to 1.6% of sodium tetraborate; 0.2 to 1.2% of anhydrous sodium hydroxide; 84 to 95% by weight of water; and 0 to 1.0% of anhydrous ammonium hydroxide.

The amounts of the various materials may be varied somewhat from the above to meet special requirements. Other ingredients, as for example, perfumes, dyes, etc., may be added so long as they do not substantially affect the performance of the compositions.

The following examples are provided to illustrate typical formulations and advantages of my invention and should not be understood as limiting the scope of my invention.

EXAMPLE 1

A general, all purpose household liquid cleaning composition was formulated by blending the following ingredients, in the order recited.

| INGEDIENT | QUANTITY IN GRAMS | PERCENT BY WEIGHT |
|---|---|---|
| Water | 3550.35 | 92.84 |
| Surfactant - CO710 | 168 | 4.39 |
| Isopropyl Alcohol | 42 | 1.10 |
| Sodium Tetraborate | 20.7 | .54 |
| Anhydrous Citric Acid | 30 | .78 |
| Anhydrous Sodium Hydroxide | 10.5 | .28 |
| Anhydrous Ammonium Hydroxide | 2.45 | .06 |
| Total | 3824 | 99.99 |

After formulation, the liquid composition was determined to have a pH of about 9.5. The determination was made by using a Beckman Zeromatic pH meter, standardized at a pH of 10 with a commercially prepared buffer solution. A sample was submitted to an independent testing laboratory to evaluate its acute oral toxicity, and its primary skin and acute eye irritative potentials in accordance with the techniques specified in the Regulations for the enforcement of the Federal Hazardous Substances Act. The following conclusions were reached: (1) The acute oral LD50 was found to be 14.7 ml/kg of body weight with 95% confidence limits of 9.51 and 22.7 ml/kg; (2) The Primary Irritation Index was found to be 0.33; (3) Very slight eye conjunctivitis was noted in two of six test rabbits at the 24 and 48 hours readings only, no other irritative effects noted; and (4) Based upon the results noted, the composition was classified as nontoxic by ingestion, not a primary skin irritant or corrosive to the skin, and not an eye irritant, as those terms are defined in the Regulations.

The composition was determined to be readily biodegradeable.

As formulated the composition was found to be suitable for use in a "spritzer" type container. Shelf life was excellent with no noticeable settling out or degradation over a period of several months.

The composition was tested in home use and excellent results were noted in the following applications. Kitchen woodwork and counters, soiled with materials found in the average kitchen, were cleaned by spraying the composition onto the woodwork and wiping with a moist sponge. No residue from the composition remained and the dirt and grime were removed. No damage to painted or varnished surfaces was noted, no residue from the composition or soil remained. In contrast, two leading household cleaners were tested in a similar fashion. One left a residue on the painted surface. Both contained warning labels warning against usage on varnished surfaces. In their concentrated form each had a pH of about 12, and each contained a hazardous substances warning label. To test their effectiveness at lower pH levels each formulation was diluted with water to a 10 to 1 ratio. The pH was then determined to be about 11. In such diluted form, the cleaning capabilities were definitely inferior to my formulation.

To further demonstrate the effectiveness of my formulation the composition was sprayed onto a carpet soiled by dog excrement. The composition effectively removed the excrement without visibly deteriorating the carpet or its color. The same test was tried with a leading, conventional, commercially available home use rug cleaner, and comparable results were obtained. However, it was noted that after my formulation was applied and the rug cleaned and dried no odor was perceived by the users. Obviously, for use in removing such materials this is an important advantage of my composition.

The pH of the leading rug cleaner tested was determined to be 9.3. An attempt was made to use it to clean kitchen woodwork in the manner hereinbefore related. The rug cleaner failed to remove the dirt and grime as my composition had done.

The two leading general purpose cleaners were not tried in the carpet cleaning test because they contained a warning against such usages. This was probably due to their high pH's which would undoubtedly have an adverse effect on the dyes or carpet.

The composition was also sprayed on an automobile to test its ability to remove road grime, etc. It performed satisfactorily and was found to exhibit two surprising properties. Firstly, it was noted that the composition removed substantial amounts of oxidized paint leaving a shining painted surface. Secondly, it was noted that on metal parts, especially aluminum and magnesium, it removed the dirt and some oxidation.

EXAMPLE 2

A second formulation, especially adapted for heavy duty usage, as for example, customary industrial usage, has the following formulation.

| INGREDIENT | QUANTITY IN GRAMS | PERCENT BY WEIGHT |
|---|---|---|
| Water | 3314.7 | 85.83 |
| Surfactant - CO710 | 336 | 8.7 |
| Isopropyl Alcohol | 84 | 2.18 |
| Sodium Tetraborate | 41.4 | 1.07 |
| Anhydrous Citric Acid | 60 | 1.55 |
| Anhydrous Sodium Hydroxide | 21 | .54 |
| Anhydrous Ammonium Hydroxide | 4.9 | .13 |
| Totals | 3862 | 100.0 |

EXAMPLE 3

An excellent wall cleaner and general purpose cleaner may be formulated as follows.

| INGREDIENT | QUANTITY IN GRAMS | PERCENT BY WEIGHT |
|---|---|---|
| Water | 3543.5 | 92.679 |
| Surfactant - CO710 | 168 | 4.394 |
| Isopropyl Alcohol | 42 | 1.098 |
| Sodium Tetraborate | 20.7 | .541 |
| Anhydrous Citric Acid | 30 | .785 |
| Anhydrous Sodium Hydroxide | 19.2 | .302 |
| Totals | 3823.4 | 99.999 |

EXAMPLE 4

A fourth formulation, especially adapted for heavy duty usage, as for example in cleaning smokehouse walls and meat packing plants, has the following formulation.

| INGREDIENT | QUANTITY IN GRAMS | PERCENT BY WEIGHT |
|---|---|---|
| Water | 3301 | 85.50 |
| Surfactant | 336 | 8.703 |
| Isopropyl Alcohol | 84 | 2.176 |
| Sodium Tetraborate | 41.4 | 1.072 |
| Anhydrous Citric Acid | 60 | 1.554 |
| Anhydrous Sodium Hydroxide | 38.4 | .995 |
| Total | 3860.8 | 100.0 |

It should be noted that this formulation, as well as that of Example 2, represents about the maximum concentration for the nonaqueous components of my composition. Above these concentrations, certain components are no longer completely soluble and tend to precipitate out. Also, the required pH, toxicity, corrosive, and eye irritation levels may be exceeded. It should also be noted that in usage, as contrasted to the as formulated concentration of Example 4, the composition may be further diluted with water. This is, of course, true of the other examples herein. Therefore, it should be noted that the concentrations of the various components, expressed throughout in terms of percent by weight, has reference to my composition on an as formulated basis and in usage they may be further diluted without departing from my invention.

It has been empirically determined that each of the ingredients of my composition is required in order to obtain the advantages of my invention, that the components when all present exhibit synergistic results. For example, it has been determined that the citric acid exhibits sequestrating tendencies which permit tap water to be utilized thus reducing formulation costs as compared to a formulation requiring the use of demineralized water. Without the use of isopropyl alcohol the cleaning ability is far inferior to that of my compositions. Borax is required to maintain the desired pH and cleaning efficiencies of the formulation.

In the foregoing examples, the nonionic surfactant employed (C0710) was manufactured by General Aniline Film Corporation. It is a commercially available, well known surfactant of the nonylphenoxypoly (ethyleneoxy) ethanol type. Other nonionic surfactants could be utilized as for example C-17 or D-25 sold commercially by Wyandotte Chemical Company. Such nonionic surfactants are ethoxylated fatty alcohols. More particularly, they are straight chain primary aliphatic specially oxyalkylated alcohols.

It should also be noted that in the examples citric acid was employed. However, its salts, for example, sodium citrate, may be substituted.

Having thus described my invention, I claim:

1. A liquid detergent composition consisting essentially of, on a percent by weight basis as formulated, about 3 to 10% of a nonionic surfactant,
1 to 3% of isopropyl alcohol,
0.78 to 3% anhydrous citric acid,
0.5 to 1.6% sodium tetraborate,
0.2 to 1.2% anhydrous sodium hydroxide, and the balance being water to make 100%,
the quantities of basic and acidic materials being selected so as to provide a composition having a pH of 9.5 or less,
said composition being nontoxic by ingestion and not a skin or eye irritant.

2. The composition of claim 1 wherein said composition consists essentially of, on a percent by weight basis as formulated, about 4.3 to 8.7% of a nonionic surfactant,
1.1 to 2.2% of isopropyl alcohol,
0.54 to 1.1% of sodium tetraborate,
0.78 to 1.6% of anhydrous citric acid,
0.27 to 0.9% of anhydrous sodium hydroxide,
0 to 0.13% of anhydrous ammonium hydroxide, and the balance being water to make 100%.

3. A liquid detergent composition consisting essentially of, on a percent by weight basis as formulated, about 4.39% of a nonionic surfactant,
1.1% of isopropyl alcohol,
0.54% of sodium tetraborate,
0.78% of anhydrous citric acid,
0.28% of anhydrous sodium hydroxide,
0.06% of anhydrous ammonium hydroxide, and
92.84% of water,
the quantities of basic and acidic materials being selected so as to provide a composition having a pH of 9.5 or less,
said composition being nontoxic by ingestion and not a skin or eye irritant.

4. A liquid detergent composition consisting essentially of, on a percent by weight basis, as formulated, about 8.7% of a nonionic surfactant,
2.18% of isopropyl alcohol,
1.07% of sodium tetraborate,
1.55% of anhydrous citric acid,
0.54% of anhydrous sodium hydroxide,
0.13% of anhydrous ammonium hydroxide, and
85.83% of water,
the quantities of basic and acidic materials being selected so as to provide a composition having a pH of 9.5 or less,
said composition being nontoxic by ingestion and not a skin or eye irritant.

* * * * *